US007874818B2

(12) United States Patent
Gottschalk et al.

(10) Patent No.: US 7,874,818 B2
(45) Date of Patent: Jan. 25, 2011

(54) ELECTRIC MOTOR FUEL PUMP HAVING A REDUCED LENGTH

(75) Inventors: Wade A. Gottschalk, Bayport, MI (US); Peter P. Kuperus, Cass City, MI (US)

(73) Assignee: TI Group Automotive Systems, L.L.C., Warren, MI (US)

( * ) Notice: Subject to any disclaimer, the term of this patent is extended or adjusted under 35 U.S.C. 154(b) by 1347 days.

(21) Appl. No.: 10/974,202

(22) Filed: Oct. 27, 2004

(65) Prior Publication Data

US 2006/0088426 A1 Apr. 27, 2006

(51) Int. Cl.
*F04B 35/04* (2006.01)
*H02K 13/00* (2006.01)

(52) U.S. Cl. ..... 417/423.7; 310/247; 417/423.3

(58) Field of Classification Search ..... 417/423.3, 417/423.7; 310/71, 233–237, 239, 248, 249, 310/247

See application file for complete search history.

(56) References Cited

U.S. PATENT DOCUMENTS

| | | | | |
|---|---|---|---|---|
| 4,600,850 | A * | 7/1986 | Mazzorana et al. | 310/242 |
| 4,728,835 | A | 3/1988 | Baines | |
| 4,748,356 | A | 5/1988 | Okashiro et al. | |
| 4,845,393 | A * | 7/1989 | Burgess et al. | 310/51 |
| 5,257,916 | A | 11/1993 | Tuckey | |
| 5,925,962 | A | 7/1999 | Kobman et al. | |
| 6,800,982 | B2 * | 10/2004 | Ebihara | 310/239 |
| 6,952,066 | B2 * | 10/2005 | Burhenne et al. | 310/239 |
| 7,157,828 | B2 * | 1/2007 | Moroto et al. | 310/261 |
| 7,195,466 | B2 * | 3/2007 | Kobayashi et al. | 417/423.7 |
| 7,396,217 | B2 * | 7/2008 | Iwanari | 417/423.7 |
| 2001/0013728 | A1 | 8/2001 | Harita et al. | |
| 2002/0062824 | A1 | 5/2002 | Fujita et al. | |
| 2002/0140313 | A1 | 10/2002 | Noya et al. | |
| 2002/0180301 | A1 | 12/2002 | Ebihara | |
| 2003/0026717 | A1 | 2/2003 | Iwanari et al. | |
| 2003/0117035 | A1 | 6/2003 | Gerstenberger | |
| 2004/0012295 | A1 | 1/2004 | Takahashi et al. | |
| 2004/0012296 | A1 | 1/2004 | Sakai et al. | |

* cited by examiner

*Primary Examiner*—Devon C Kramer
*Assistant Examiner*—Patrick Hamo
(74) *Attorney, Agent, or Firm*—Reising Ethington P.C.

(57) ABSTRACT

An electric motor and fuel pump assembly with a housing having generally opposed ends with an electric motor within the housing having an armature with an axial commutator adjacent one end of the armature and one end of the housing. A fuel pump is positioned adjacent another end of the housing and the armature and is operably connected to the armature for being driven by the electric motor. A carrier within the housing has guides slidably receiving axially elongate brushes disposed generally parallel to the armature axis with ends contacting the commutator. Each brush is biased generally axially into contact with the commutator by a torsional spring with a coiled body having an axis generally transverse to the axis of the armature to decrease the overall axial length of the pump assembly. Preferably an end cover of the housing overlies and encloses the springs and brushes and preferably has an outlet port laterally offset from the brushes and within the outer periphery of the end cover to further decrease the overall axial length of the fuel pump assembly. Preferably electrical connector blades extend through the end cover and are laterally offset from and axially overlap in electrical connection with the brushes for supplying current to the motor.

10 Claims, 4 Drawing Sheets

ELECTRIC MOTOR FUEL PUMP HAVING A REDUCED LENGTH

FIELD OF THE INVENTION

This invention relates generally to fuel pumps, and more particularly to a fuel pump that is used in a fuel tank and that has an electric motor with brushes.

BACKGROUND OF THE INVENTION

Electric motor fuel pumps are widely used to supply fuel to operating internal combustion engines, such as in automotive applications. A fuel pump is typically disposed within a fuel tank and has a lower inlet end for drawing fuel from within the tank and an upper outlet end for outputting drawn fuel under pressure to the engine. Examples of fuel pumps of this general type are illustrated in U.S. Pat. Nos. 5,257,916, and 6,231,318. As shown in FIG. 8, a prior art fuel pump 210 includes a cylindrical metal housing 212 that connects to an inlet cover 214 at a lower inlet end 216 and to an outlet cover 218 at an upper outlet end 220. Although not shown in the figure, there are several components within the housing 212 and between the covers 214, 218. Stacked axially from the lower inlet end, there is a pump assembly typically including an impeller, ring, and pump plate, an electric motor including a flux tube, stator, and armature with an axial commutator, and an armature cover between the armature and the outlet cover. As shown in FIG. 8, the outlet cover 218 includes an axially-projecting male outlet 222 for connecting to an outlet hose (not shown) and also includes terminal blades 224 for connecting to an electrical connector (not shown).

In general, the electric motor of a typical fuel pump is connected to a source of electrical power for driving the armature about its axis of rotation. The armature cover includes the terminal blades, which are fixed thereto and which communicate with axially-extending internal pockets of the armature cover. Internally, the armature cover includes the pockets for housing elongated carbon brushes that are spring-loaded into contact with the axial commutator. The brushes are spring-loaded by axially-extending compression springs that are disposed between upper ends of the carbon brushes and bottoms of the pockets. In other words, each compression spring and brush is aligned in series along a common operational axis and is disposed parallel to the axis of rotation of the armature. The terminal blades are in electrical contact with the axially extending springs, carbon brushes, and commutator, in order to power the electric motor of the fuel pump.

In use, such a state of the art fuel pump is typically disposed within an automotive fuel tank so that their axis extends generally vertically. Automobile designers find it increasingly desirable to package fuel tanks and, thus, fuel pumps, in vertically more confined spaces such as underneath a rear seat of a vehicle. Therefore, the fuel tank and fuel pump must be as axially short as possible. But, current fuel pumps are too axially long to be packaged in such a location. For in-tank vehicle applications, these fuel pumps must also have a small maximum diameter which is usually less than about 2 inches and typically about 1½ inches.

SUMMARY OF THE INVENTION

A fuel pump assembly with a short axial length having a housing with a fuel pump therein adjacent one end and a generally axially aligned electric motor with an axial commutator and at least one axially extending brush biased to contact the commutator by a laterally offset spring therein adjacent the other end of the housing. Preferably, the motor has a pair of brushes each biased by a separate laterally offset spring in contact with the commutator.

This spring is preferably a coiled torsional spring with a coiled body having an axis that is transverse to the longitudinal axis of the electric motor and housing. Preferably an end cover of the housing encloses the brushes and spring and preferably has a generally axially extending female fuel outlet port therein. Preferably axially extending electrical terminal blades overlap the brushes and extend axially from the cover to provide an external electrical connection for supplying electric power to the motor.

Some objects, features and advantages of the present invention include providing a brush-type electric fuel pump assembly that is readily adaptable to various fuel tank and vehicle applications including under-seat applications; has a reduced axial length on the order of 25% reduction in overall length compared to prior art designs; does not require a space-consuming male outlet fitting; does not require space-consuming axially-oriented compression springs; is of relatively simple design and economical manufacture and assembly; is rugged, durable, and reliable; and has a long, useful life in service.

Of course, other objects, features and advantages will be apparent in view of this disclosure to those skilled in the art. Fuel pumps embodying the invention may achieve more or less than the noted objects, features or advantages.

BRIEF DESCRIPTION OF THE DRAWINGS

These and other objects, features and advantages of the present invention will be apparent from the following detailed description of the preferred embodiment(s), appended claims, and accompanying drawings in which:

DETAILED DESCRIPTION OF THE PREFERRED EMBODIMENTS

Figure 1A:
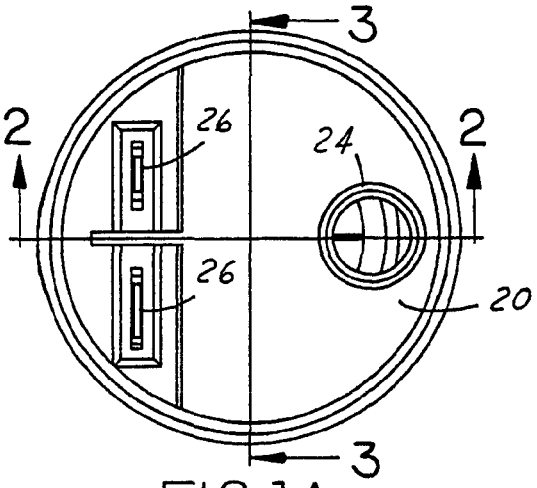
FIG. 1A is a top end view of the fuel pump of FIG. 1.
Figure 1:
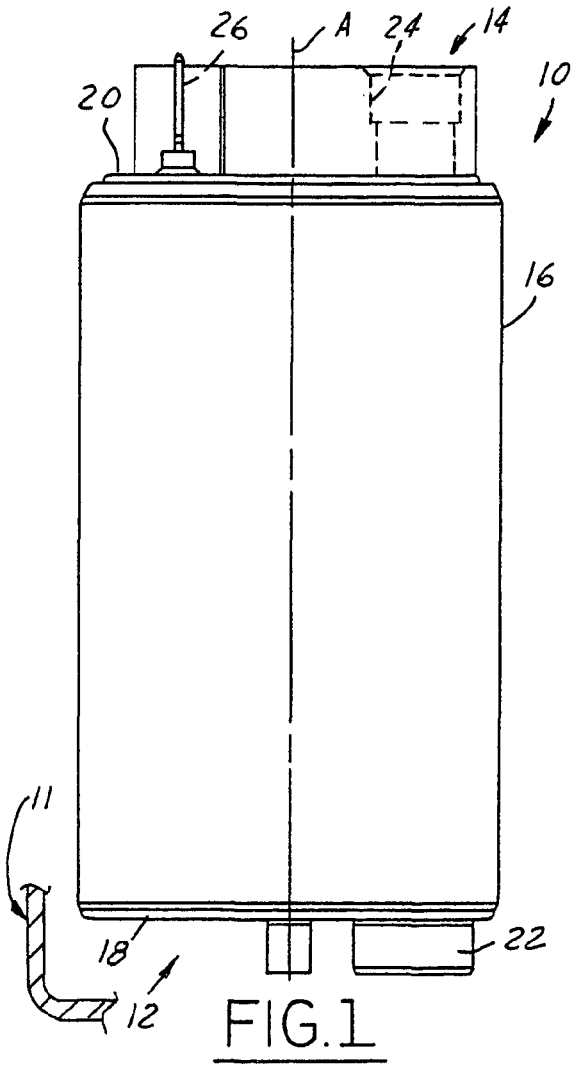
FIG. 1 is a plan view of an electric motor fuel pump according to one embodiment of the present invention.

Referring in detail to the drawings, FIG. 1 illustrates an electric motor and fuel pump assembly 10 that is typically mounted with its longitudinal axis A extending generally vertically in a fuel tank 11 of an automotive vehicle (not shown), with an inlet end 12 positioned adjacent a bottom portion of the fuel tank to pick up fuel and deliver the fuel at a higher pressure through an oppositely disposed outlet end 14. A cylindrical housing sleeve 16 generally defines the longitudinal axis A of the electric motor and fuel pump assembly 10 and connects an inlet cover 18 at the inlet end 12 to an outlet cover 20 at the outlet end 14. The inlet cover 18 includes an inlet port 22 extending axially therefrom for drawing fuel into the electric motor and fuel pump assembly 10.

Figure 8:
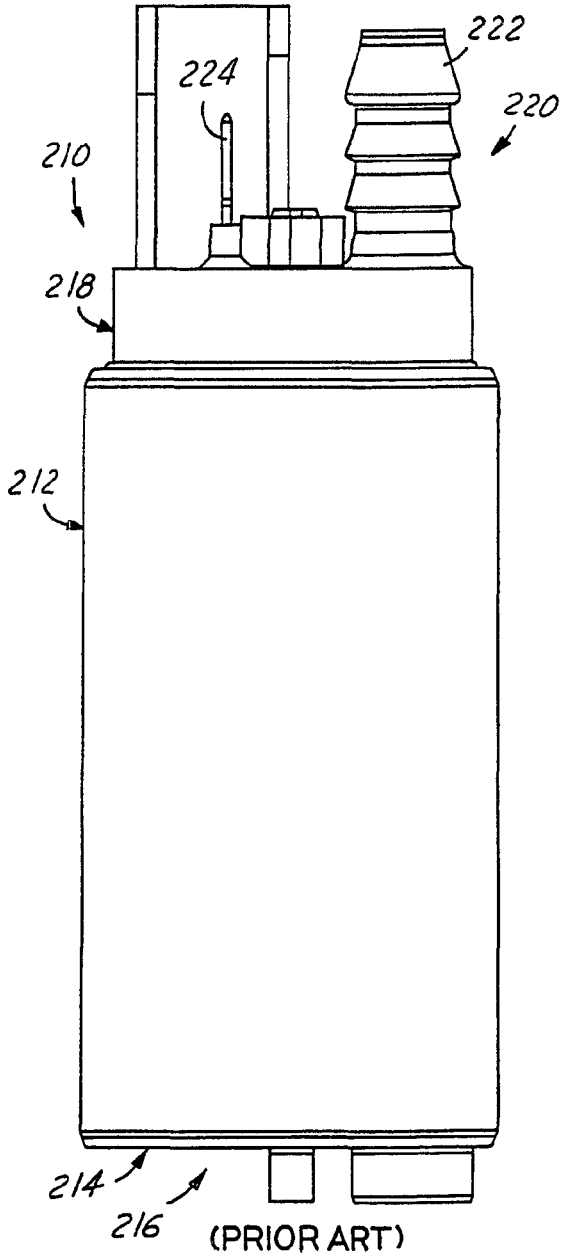
(PRIOR ART) FIG.8
FIG. 8 is a plan view of a prior art fuel pump.

As shown in FIGS. 1 and 1A, the outlet cover 20 includes a female outlet port 24 and axially-extending electrical terminal blades 26 molded or assembled thereto. The outlet port 24 is adapted for attachment to a tube having an O-ring seal (not shown), such as a block tube connector type of fluid connection. The terminal blades 26 are adapted for connecting to a female electrical connector (not shown) as is known in the art. In comparing the present invention with the prior art FIG. 8, it is clear that the female outlet port 24 of the present invention contributes to a more compact fuel pump design. Other aspects of the present invention contribute to the compactness of the electric motor and fuel pump assembly 10, as will be discussed in more detail below.

Figure 2:
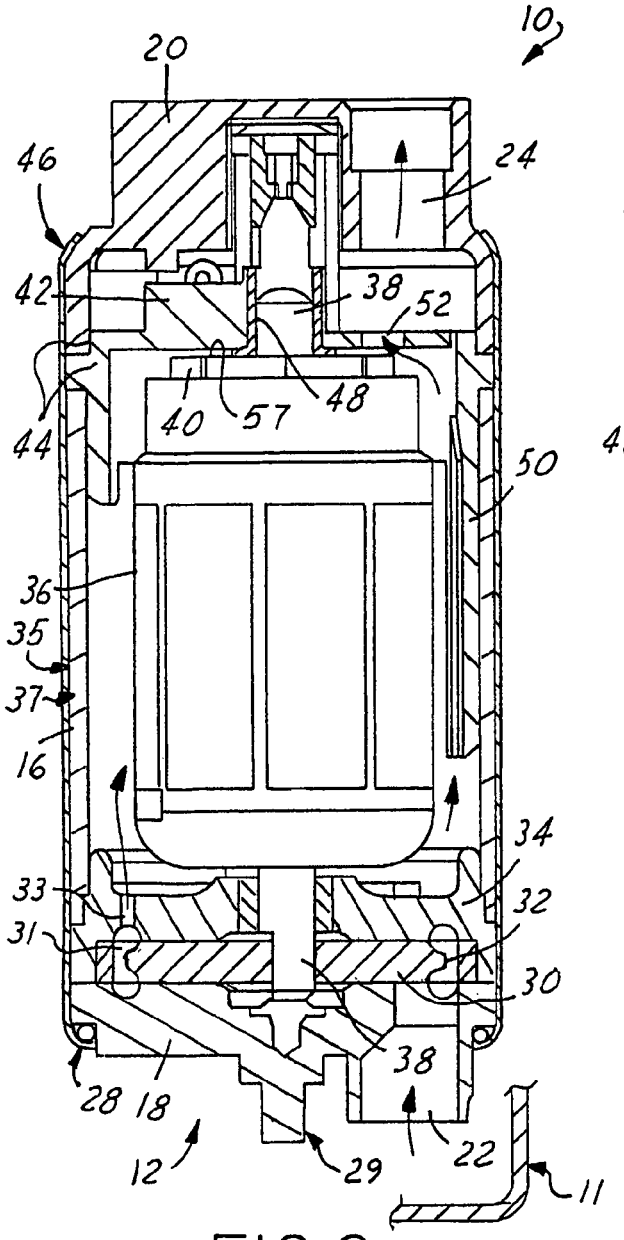
FIG. 2 is a cross-sectional view of the fuel pump of FIG. 1, taken along line 2-2 of FIG. 1A.

As shown in FIG. 2, a fuel pump assembly 29 driven by a D.C. electric motor 35 is received in the housing 16. The pump assembly 29 is a turbine pump with an impeller 30 received for rotation between a pump plate 34 and the inlet cover 18 which is retained in the housing sleeve 16 by a rolled over end 28 of the housing sleeve 16. The impeller 30 has an array of circumferentially spaced apart vanes 32 with pockets between adjacent vanes 32 which are received in a pumping chamber or channel 31 to which fuel is supplied through the pump inlet 22 and is discharged at a higher pressure through an outlet 33 of the pump plate 34 when the impeller 30 is rotated by the electric motor 35. The type of pump used is not germane to the particular novel aspects of the present invention and, therefore, the present invention contemplates use of any suitable pump assembly including positive displacement pumps such as roller-cell pumps and internal gear pumps, and turbine pumps such as side channel pumps, peripheral vane pumps, or any combination thereof.

The electric motor 35 has a stator 37 with a flux tube and permanent magnets (not shown), and an armature 36 with a shaft 38 extending through the pump plate 34 and drivingly connected to the impeller 30. At an opposite end of the armature 36 there is disposed an axial commutator 40. An armature cover 42 is positioned over the armature 36 facing the axial commutator 40 and includes an annular shoulder 44 received in an outlet end 46 of the housing sleeve 16 and a central aperture with a bushing or bearing 48 therein for journaling rotation of an upper end of the armature shaft 38. The outlet cover 20 is retained in the housing sleeve 16 by a rolled over end 46 of the housing sleeve 16.

In operation, the electric motor 35 is energized by an external power source whereby the armature 36 and its shaft 38 rotate so as to rotate the impeller 30 of the fuel pump assembly 29, thereby drawing fuel from the fuel tank 11 through the inlet port 22 of the inlet cover 18, through the impeller 30, the pumping channel 31, and outlet 33 in the pump plate 34, into the space between the armature 36 and housing sleeve 16, substantially up a collector extension 50 of the armature cover 42, through an aperture 52 in the armature cover 42, and out the outlet port 24 of the outlet cover 20. As can be seen in this view, providing the female outlet port 24, instead of a space-wasting male outlet port, tends to make the electric motor and fuel pump assembly 10 more axially compact.

Figure 3:
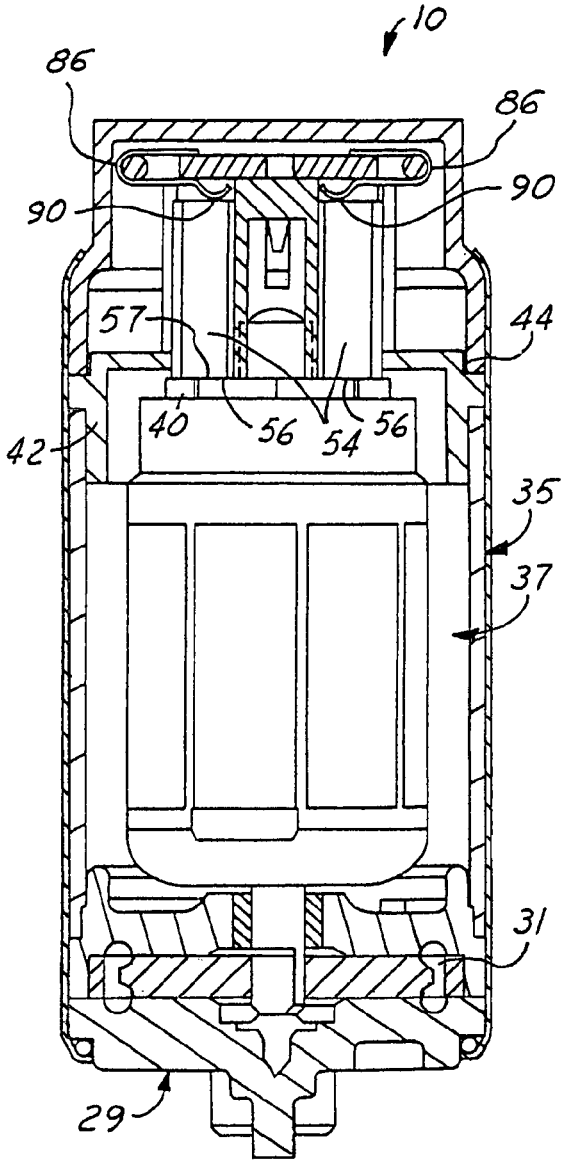
FIG. 3 is a cross-sectional view of the fuel pump of FIG. 1, taken along line 3-3 of FIG. 1A.
Figure 4:
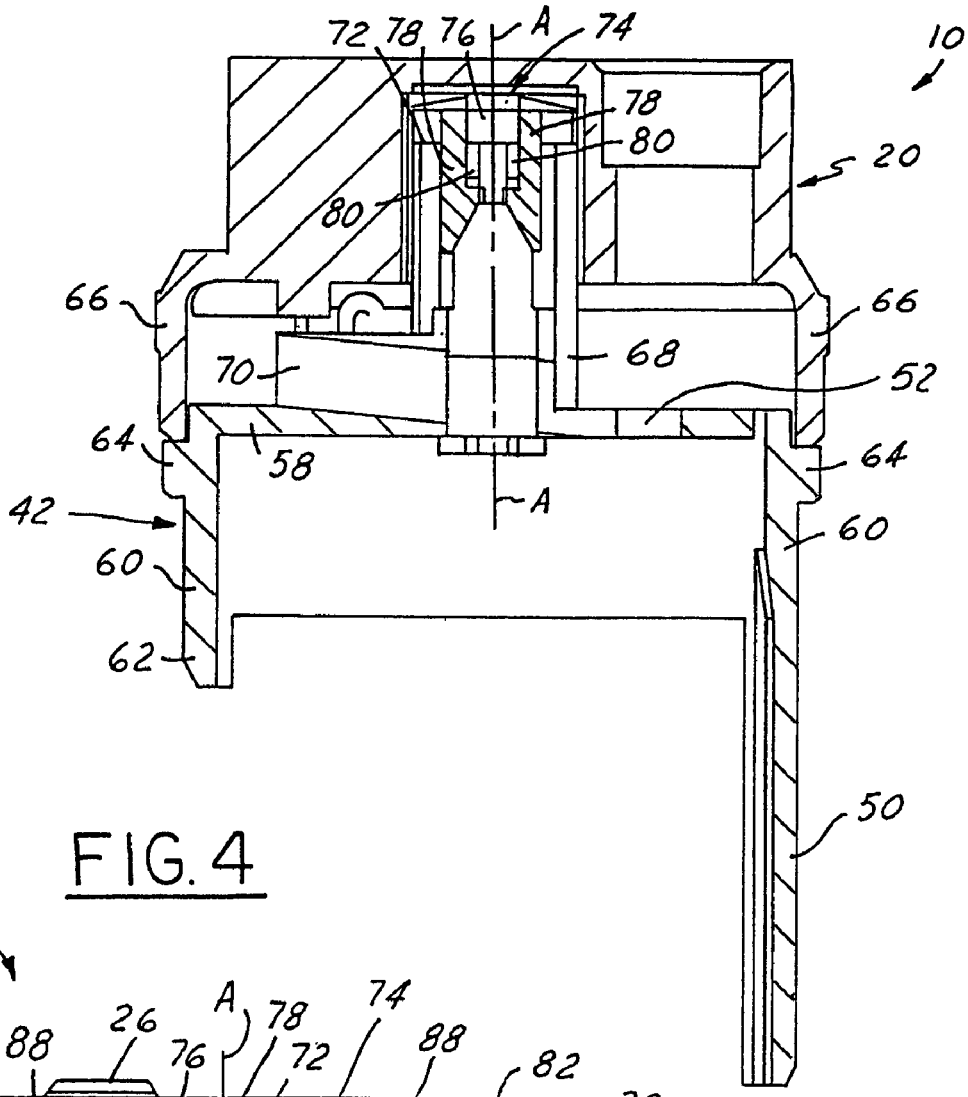
FIG. 4 is an enlarged cross-sectional view of an outlet cover and an armature cover of the fuel pump of FIG. 2.

As shown in FIG. 3, the armature cover 42 slidably receives a pair of carbon brushes 54 with bottom ends 56 each yieldably urged by a spring 86 into contact with an end face 57 of the axial commutator 40. The brushes 54 are axially elongate and disposed parallel to and laterally spaced from the longitudinal axis A of rotation of the armature 36. The end face 57 of the commutator 40 has an array of circumferentially spaced apart electrical contacts with faces (not shown) which collectively substantially lie in a plane substantially perpendicular to the axis rotation of the armature 36.

As shown in FIGS. 4-7, the armature cover 42 has an inverted generally cup shape with a base 58 which preferably is generally planar and a depending annular skirt 60 with a depending pilot extension 62 generally diametrically opposed to the depending collector extension 50. To facilitate fuel flow through the cover 42, the base 58 has a generally D-shaped hole 52 therethrough. An annular shoulder for receiving the end cover 20 is formed by a radially projecting and preferably circumferentially continuing rib 64 of the skirt 60. In assembly, the lower edge of the rib 64 bears on an end face of the stator flux tube which axially locates the armature cover 42 with respect to the stator and armature. A brush carrier or holder 68 extends axially upward from the base 58 and has a pair of axially extending through guides or slots 69 for slidably receiving and retaining the brushes 54 and terminates in a preferably planar end face 72 on which a spring retainer assembly 74 is received. The retainer assembly 74 has a generally planar base plate 76 which is releasably mounted on the free end face 72 of the brush holder 68 by a preferably integral pair of depending fastening prongs 78 which are somewhat flexible and resilient and in assembly slide over and snap into engagement with catch features 80 of the brush holder 68.

Figure 5:
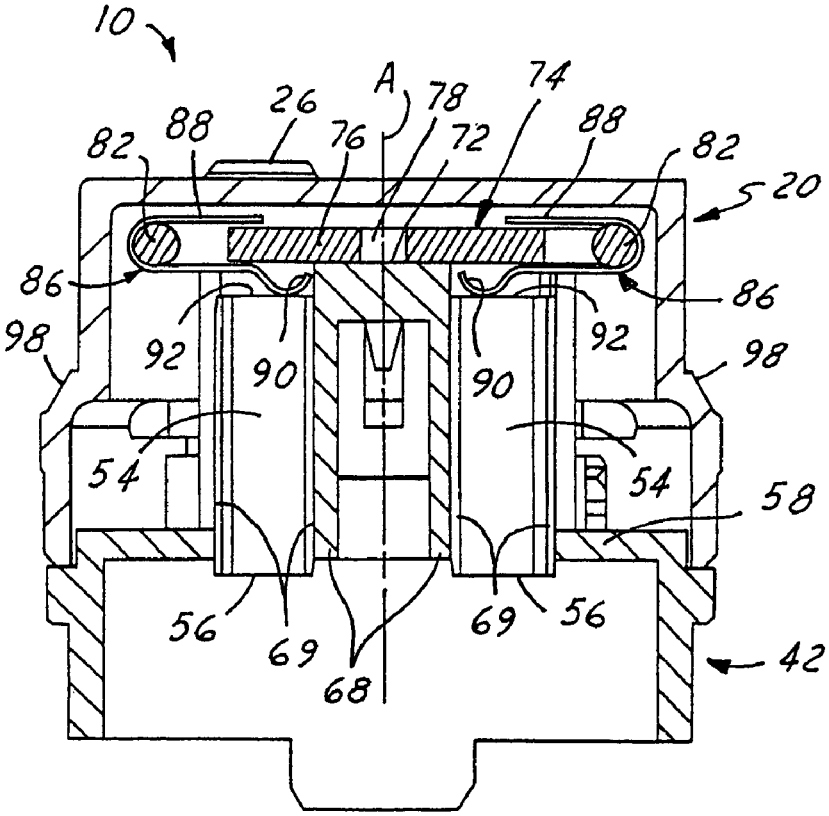
FIG. 5 is an enlarged cross-sectional view of the outlet cover and the armature cover of the fuel pump of FIG. 3.
Figure 6:
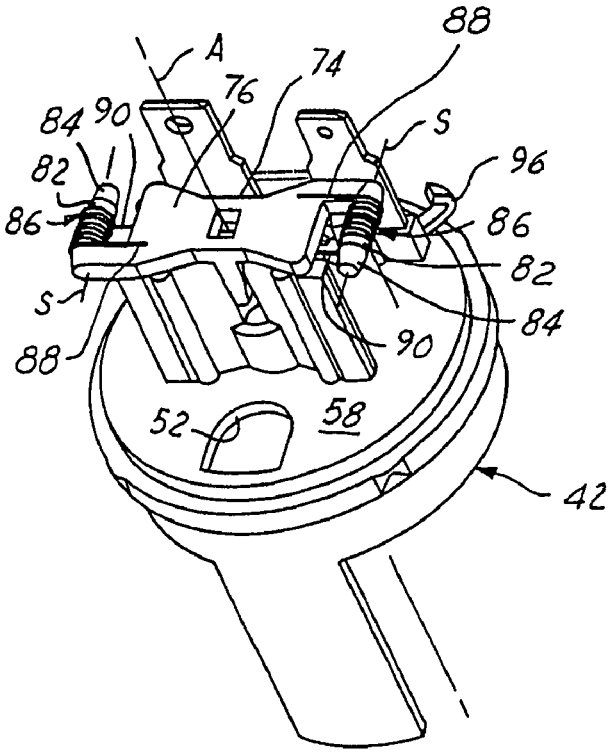
FIG. 6 is an enlarged front perspective view of the armature cover of FIGS. 4 and 5.
Figure 7:
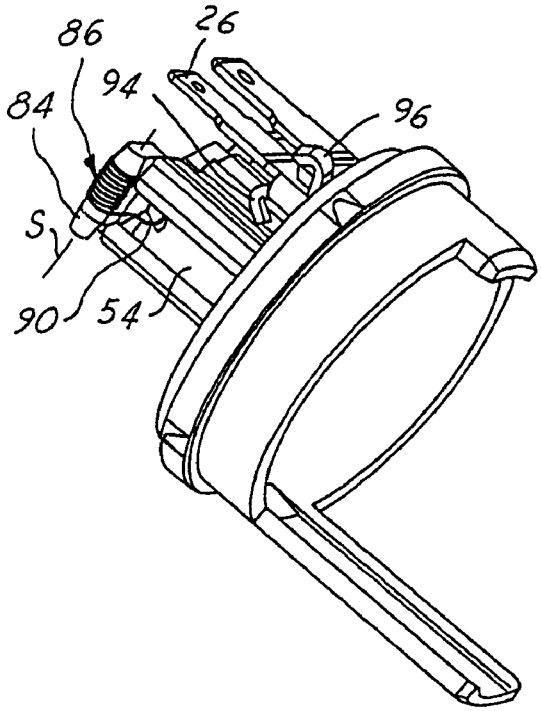
FIG. 7 is an enlarged rear perspective view of the armature cover of FIGS. 4 and 5.

As best shown in FIGS. 5 and 6, in assembly the base plate 76 of the retainer 74 extends substantially transversely to the longitudinal axis A of the electric motor and fuel pump assembly 10 and terminates in transversely extending spring posts 82 that are laterally offset from the centerline of the fuel pump. As shown in FIGS. 6 and 7, the spring posts 82 are provided with tapered free ends 84 to facilitate insertion thereover of coiled torsional springs 86. Each spring 86 has a coil axis S and a reaction end 88 that bears against the base plate 76 of the retainer assembly 74 and an opposite action end 90 which bears on a brush 54. As better shown in FIG. 5, the reaction ends 88 overlie the base plate 76 and are trapped between the base plate 76 of the retainer assembly 74 and the outlet cover 20. Preferably, the action ends 90 terminate in curved portions that bear on the upper ends 92 of the brushes 54 to downwardly bias the brushes 54 to maintain contact between the bottom ends 56 of the brushes 54 and the axial commutator (40 in FIGS. 2 and 3). The springs 86 are laterally offset and their coil axes S extend transversely with respect to the longitudinal axes of the brushes 54 to decrease the axial length of the pump assembly 10.

Referring to FIG. 7, each terminal blade 26 has a bent prong 94 that is electrically connected to an associated brush 54 to provide electricity to the commutator 40 of the electric motor. Also, as shown in FIGS. 6 and 7, a bent ground prong 96 provides a ground contact between one of the terminal blades 26 and the metal housing sleeve of the fuel pump.

Referring to FIG. 5, in assembling the pump assembly 10, the armature cover 42 is sub-assembled as one unit, wherein the springs 86 are assembled to the respective spring posts 82 and then the spring retainer assembly 74 is snapped into place on the brush holder 68. Then the outlet cover 20 may be assembled over the armature cover 42 to enclose and protect the springs 86 and retainer 74 and trap the reaction ends 88 of the springs 86 between the inside of the outlet cover 20 and the base plate 76 of the retainer assembly 74. The outlet cover 20 and armature cover 42 may be inverted and the brushes 54 inserted into their respective pockets, guides, or slots 69 of the brush holder 68 to bear on the action ends 90 of the springs 86. Then, the rest of the pre-assembled fuel pump may likewise be inverted and assembled over the armature cover 42, thereby engaging the spring-loaded brushes 54 with the commutator 40, and the housing sleeve 16 is then rolled over a shoulder 98 of the outlet cover 20 as shown in FIGS. 2 and 3. Accordingly, as shown in FIG. 3, the brushes 54 are trapped between the action ends 90 of the springs 86 and the commutator 40 and spring-biased into engagement with the end face 57 of the commutator 40.

The present invention provides a fuel pump that is more axially compact than prior art designs, specifically on the order of about 25% shorter in overall axial length. The outlet cover includes a female outlet port or even a recessed male outlet which is laterally offset from and axially overlaps the brushes, instead of a relatively long axially-extending male outlet tube extending outwardly from beyond the brushes. The assembly includes transversely extending torsional springs, instead of relatively space-consuming, axially-oriented compression springs, for biasing the brushes against an axial commutator of an electric motor of the fuel pump. Skilled persons will appreciate that other forms of springs may be used to bias the brushes into engagement with the commutator which springs overlap the brushes or are otherwise disposed so that they do not extend significantly beyond the ends of the brushes distal from the commutator while still axially biasing the brushes into engagement with the commutator.

While the forms of the invention herein disclosed constitute a presently preferred embodiment, many others are possible. For example, the features and functionalities of the outlet cover and armature cover could be combined into a single cover if desired. Moreover, the coiled torsional springs could be replaced with equivalent structure including, but not limited to, cantilevered leaf springs and flat wire coiled constant rate springs. It is not intended herein to mention all the possible equivalent forms or ramification of the invention. It is understood that terms used herein are merely descriptive, rather than limiting, and that various changes may be made without departing from the spirit and scope of the invention as defined by the following claims.

What is claimed is:

1. An electric motor and fuel pump assembly comprising:

a housing having a pair of generally opposed ends;

an electric motor disposed within the housing and having an armature with a shaft with an axis of rotation and an axial commutator adjacent one end thereof and adjacent one end of the housing with the shaft extending axially outward of the commutator;

a fuel pump disposed within the housing adjacent one of the ends of the housing, and operably connected to the armature to be driven by the electric motor;

a brush carrier disposed within the housing adjacent the commutator and having a brush guide to slidably receive an electrically conductive and axially elongate brush with the brush being radially spaced from the shaft with the axis of the brush generally parallel to the axis of rotation of the armature shaft;

the electrically conductive and axially elongate brush slidably received in the brush guide and radially spaced from and axially overlapping the shaft, wherein the brush has generally opposed ends with one end contacting the commutator, wherein the axis of the brush is generally parallel to the axis of rotation of the armature shaft;

a spring associated with the brush and bearing on another end of its associated brush to yieldably bias its associated brush into contact with the commutator and the spring having a body radially spaced from the brush and axially adjacent the brush and radially spaced from the armature shaft;

an outlet cover overlying the brush and spring and including an end with a female fuel outlet port radially spaced from the armature shaft and extending into the cover and axially overlapping the brush and spring and laterally spaced from the brush; and the spring comprises a torsional spring having a coiled body with an axis disposed transversely to the axis of rotation of the armature shaft and the coiled body is axially spaced from and does not axially overlap the brush.

2. The electric motor and fuel pump assembly of claim 1 which also comprises at least one electrical connector blade radially spaced from and axially overlapping the brush and projecting through the outlet cover to the exterior of the outlet cover for at least in part providing an electrical connection to the brush.

3. The electric motor and fuel pump assembly of claim 1 wherein the housing has a substantially cylindrical sleeve generally defining a longitudinal axis of the electric motor and fuel pump assembly, the housing having an outlet end and further comprising:

an armature cover positioned at least partially within the outlet end of the housing and at the one end of the electric motor facing the axial commutator, the armature cover including two brush guides and a brush disposed in each guide, the brushes having ends in contact with the axial commutator of the electric motor, the armature cover including two springs, the springs being coiled torsional springs having bodies with coil axes that are transversely oriented with respect to the longitudinal axis defined by the housing, the bodies each being axially spaced from and not overlapping the brushes, the coiled torsional springs having action ends biased against the other ends of the brushes, thereby spring-loading the brushes into contact with the axial commutator and also having reaction ends trapped by the outlet cover.

4. The electric motor and fuel pump assembly of claim 3 wherein the armature cover comprises:

a cover portion having a substantially planar transversely extending base and the brush guides extend axially from the base; and a retainer portion integrally attached to the cover portion at the brush guide, the retainer portion having a body retainer portion and laterally opposed spring posts transversely extending from the body retainer portion through the coiled torsional springs, the spring posts being radially and axially spaced from and not axially overlapping the brushes.

5. The electric motor and fuel pump assembly of claim 4 wherein the coiled torsional springs have the action ends located against the other ends of the brushes and also have the oppositely disposed reaction ends trapped between the retainer portion and the outlet cover.

6. An apparatus for an electric motor and fuel pump assembly which has a housing that has at least one end and the housing generally defines a longitudinal axis of the electric motor and fuel pump assembly, the electric motor and fuel pump assembly also has an electric motor with an axial commutator that is disposed within the housing, the apparatus comprising:

at least one cover being adapted for positioning at least partially within the at least one end of the housing and facing the axial commutator, the at least one cover being adapted to include at least one brush disposed therein, the at least one brush being adapted to have one end thereof in contact with the axial commutator of the electric motor, the at least one cover including at least one spring having a body that is radially spaced from the at least one brush, the at least one spring being adapted to have a portion biased against an opposite end of the at least one brush for spring-loading the at least one brush into contact with the axial commutator wherein the at least one cover includes an outlet cover with an outer end overlying the at least one brush and the at least one spring and including a female fuel outlet port radially spaced from the longitudinal axis, extending into the cover from the outer end and laterally spaced from both and axially overlapping both the at least one brush and the at least one spring; and the at least one spring comprises at least one coiled torsional spring with a body having a coil axis that is radially and axially spaced from the brush, does not axially overlap the brush, and is transversely oriented with respect to the longitudinal axis defined by the housing.

7. The electric motor and fuel pump assembly of claim 6 wherein the at least one cover includes an armature cover including a brush carrier for holding the at least one brush and also including a spring retainer coupled to the brush carrier for holding the at least one spring.

8. An electric motor and fuel pump assembly comprising:

a housing;

an inlet cover coupled to the housing and including an inlet port;

an outlet cover coupled to the housing;

a fuel pump disposed within the housing adjacent the inlet cover;

an electric motor disposed within the housing between the fuel pump and the outlet cover, coupled to the fuel pump to drive the fuel pump, and having an armature with an axis of rotation and an axial commutator;

a brush carrier disposed within the housing between the axial commutator and the outlet cover, and including brush guides disposed side-by-side to slidably receive an axially elongate brush with the brush being radially spaced from the axis of rotation of the armature and with the axis of the brush generally parallel to the axis of rotation of the armature;

axially elongate brushes slidably received in the brush guides, substantially parallel to each other and the axis of rotation of the armature, and each having an end in contact with the commutator;

a spring retainer coupled to the brush carrier and having laterally opposed spring posts radially spaced from and each disposed radially outboard of an associated brush;

springs including bodies disposed on the spring posts of the spring retainer and axially spaced from and not axially overlapping the brush, reaction ends, and action ends bearing on other ends of the brushes to yieldably bias the brushes into contact with the commutator; and the outlet cover assembled over the spring retainer to trap the reaction ends of the springs between the outlet cover and the spring retainer, and the outlet cover including a female fuel outlet port radially spaced from the axis of rotation of the armature and laterally spaced from and axially overlapping the brushes.

9. A cover apparatus for an electric motor and fuel pump assembly comprising:

an armature cover including a base and a brush carrier extending from the base and defining side-by-side brush guides each radially spaced from an axis of rotation of an armature of the electric motor and constructed to slidably receive axially elongate brushes radially spaced from and generally parallel to the axis of rotation of the armature, and a spring retainer coupled to the brush carrier and having laterally opposed portions;

axially elongate brushes slidably received in the brush guides and radially spaced from and substantially parallel to the axis of rotation of the armature and axially overlapping an end of a shaft of the armature;

springs having bodies coupled to the laterally opposed portions of the spring retainer and positioned radially outboard of the brushes and axially spaced from and not axially overlapping the brushes and having ends in contact with the brushes to spring-load the brushes; and an outlet cover over the armature cover and the brush carrier and having an outer end with a female fuel outlet extending from the outer end into the outlet cover, radially spaced from the axis of rotation of the armature and the armature shaft and laterally spaced from and axially overlapping both the brushes and springs.

10. An electric motor and fuel pump assembly comprising:

a housing having a pair of generally opposed ends;

an electric motor disposed within the housing and having an armature with a shaft with an axis of rotation and an axial commutator adjacent one end thereof and adjacent one end of the housing with the shaft extending axially outward of the commutator;

a fuel pump disposed within the housing adjacent one of the ends of the housing, and operably connected to the armature to be driven by the electric motor;

a brush carrier disposed within the housing adjacent the commutator and having a brush guide to slidably receive a brush with the brush being radially spaced from the shaft with the axis of the brush generally parallel to the axis of rotation of the shaft;

an electrically conductive brush slidably received in the brush guide and radially spaced from and axially overlapping the shaft, wherein the brush has generally opposed ends with one end contacting the commutator, wherein the axis of the brush is generally parallel to the axis of rotation of the armature shaft;

a spring associated with the brush and bearing on another end of its associated brush to yieldably bias its associated brush into contact with the commutator and the spring having a coiled body with an axis disposed transversely to the axis of rotation of the armature and radially spaced from the brush; and an outlet cover overlying the brush and spring and including an outer end with a female fuel outlet port radially spaced from the armature shaft and extending only into the cover and axially overlapping the brush and spring and laterally spaced from the brush.

* * * * *